US010775048B2

(12) United States Patent
Patel et al.

(10) Patent No.: US 10,775,048 B2
(45) Date of Patent: Sep. 15, 2020

(54) FUEL NOZZLE FOR A GAS TURBINE ENGINE

(71) Applicant: General Electric Company, Schenectady, NY (US)

(72) Inventors: Nayan Vinodbhai Patel, Liberty Township, OH (US); Alfred Albert Mancini, Cincinnati, OH (US); Duane Douglas Thomsen, Lebanon, OH (US)

(73) Assignee: General Electric Company, Schenectady, NY (US)

( * ) Notice: Subject to any disclaimer, the term of this patent is extended or adjusted under 35 U.S.C. 154(b) by 653 days.

(21) Appl. No.: 15/459,345

(22) Filed: Mar. 15, 2017

(65) Prior Publication Data

US 2018/0266693 A1 Sep. 20, 2018

(51) Int. Cl.

| | |
|---|---|
| ***F23R 3/34*** | (2006.01) |
| ***F23R 3/28*** | (2006.01) |
| ***F23D 11/38*** | (2006.01) |

(52) U.S. Cl.

CPC ..... *F23R 3/343* (2013.01); *F23D 11/38* (2013.01); *F23R 3/283* (2013.01); *F23R 3/286* (2013.01)

(58) Field of Classification Search

CPC .. F23R 3/28; F23R 3/283; F23R 3/286; F23R 3/34; F23R 3/343; F23R 3/346

See application file for complete search history.

(56) References Cited

U.S. PATENT DOCUMENTS

| | | | | |
|---|---|---|---|---|
| 3,695,384 | A | 10/1972 | Schiess | |
| 4,986,068 | A | 1/1991 | Lee et al. | |
| 5,243,816 | A | 9/1993 | Huddas | |
| 6,804,946 | B2 | 10/2004 | Willis et al. | |
| 6,898,926 | B2 | 5/2005 | Mancini | |
| 6,898,938 | B2 | 5/2005 | Mancini et al. | |
| 6,959,535 | B2 | 11/2005 | Mancini et al. | |
| 7,036,302 | B2 | 5/2006 | Myers, Jr. et al. | |
| 7,464,553 | B2 * | 12/2008 | Hsieh | F23R 3/14 60/740 |
| 7,788,927 | B2 * | 9/2010 | McMasters | F23R 3/283 60/739 |
| 8,220,270 | B2 | 7/2012 | Bathina et al. | |
| 8,443,609 | B2 | 5/2013 | Doerr et al. | |
| 8,474,266 | B2 | 7/2013 | Berry et al. | |
| 8,522,554 | B2 | 9/2013 | Intile et al. | |
| 8,555,645 | B2 | 10/2013 | Duncan et al. | |
| 8,851,402 | B2 | 10/2014 | Dinu et al. | |
| 9,453,461 | B2 | 9/2016 | Patel et al. | |

(Continued)

FOREIGN PATENT DOCUMENTS

WO WO2015/122952 A2 8/2015

*Primary Examiner* — Arun Goyal

(74) *Attorney, Agent, or Firm* — Dority & Manning, P.A.

(57) ABSTRACT

A fuel nozzle for a gas turbine engine includes an outer body extending generally along a centerline axis and defining a plurality of openings in an exterior surface. The fuel nozzle additionally includes a main injection ring disposed at least partially inside the outer body, the main injection ring including a fuel post extending into or through one of the plurality of openings of the outer body. The fuel post defines a spray well and a main fuel orifice, the spray well defining a bottom surface, a side wall, and a taper in the bottom surface extending from the main fuel orifice towards the side wall.

17 Claims, 8 Drawing Sheets

(56) References Cited

U.S. PATENT DOCUMENTS

| | | | | |
|---|---|---|---|---|
| 2007/0028618 | A1* | 2/2007 | Hsiao | F23R 3/14 60/737 |
| 2009/0255256 | A1* | 10/2009 | McMasters | B22F 3/1055 60/734 |
| 2016/0017809 | A1 | 1/2016 | Ott et al. | |
| 2016/0305327 | A1 | 10/2016 | Patel et al. | |

* cited by examiner

FUEL NOZZLE FOR A GAS TURBINE ENGINE

FIELD

The present subject matter relates generally to a fuel nozzle for a gas turbine engine.

BACKGROUND

A gas turbine engine generally includes a fan and a core arranged in flow communication with one another. Additionally, the core of the gas turbine engine generally includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air using one or more fuel nozzles within the combustion section and burned to provide combustion gases. The combustion gases are routed from the combustion section to the turbine section. The flow of combustion gasses through the turbine section drives the turbine section and is then routed through the exhaust section, e.g., to atmosphere.

More specifically, the fuel nozzles function to introduce liquid fuel into an air flow stream such that the liquid fuel may atomize and burn. Additionally, staged fuel nozzles have been developed to operate with relatively high efficiency and operability. In a staged fuel nozzle, fuel may be introduced through two or more discrete stages, with each stage being defined by an individual fuel flow path within the fuel nozzle. For example, at least certain staged fuel nozzles include a pilot stage that may be operable continuously, and a main stage that operates at, e.g., high power levels.

With certain embodiments, the main stage may include an annular main injection ring having a plurality of fuel injection ports which discharge fuel through a round centerbody into a swirling mixer airstream. When the main stage is not in use, it may be beneficial to purge at least a portion of the fuel therein such that the fuel does not increase in temperature and begin to coke. Accordingly, a fuel nozzle with one or more features enabling the main stage of the fuel nozzle to purge at least a portion of the fuel therein would be useful.

BRIEF DESCRIPTION

Aspects and advantages of the invention will be set forth in part in the following description, or may be obvious from the description, or may be learned through practice of the invention.

In one exemplary embodiment of the present disclosure a fuel nozzle for a gas turbine engine is provided. The fuel nozzle defines a centerline axis and includes an outer body extending generally along the centerline axis and defining an exterior surface, the outer body defining a plurality of openings in the exterior surface. The fuel nozzle additionally includes a main injection ring disposed at least partially inside the outer body, the main injection ring including a fuel post extending into or through one of the plurality of openings of the outer body. The fuel post defines a spray well and a main fuel orifice, the spray well defining a bottom surface, a side wall, and a taper in the bottom surface extending from the main fuel orifice towards the side wall.

In certain exemplary embodiments the main fuel orifice defines a centerline, wherein the taper extends at least about twenty degrees about the centerline of the main fuel orifice.

In certain exemplary embodiments the main fuel orifice defines a centerline, wherein the taper extends at least about forty-five degrees about the centerline of the main fuel orifice.

In certain exemplary embodiments the fuel post defines a top surface, wherein the taper defines a projection angle with a reference plane extending parallel to the top surface, and wherein the projection angle is greater than zero degrees and less than about seventy-five degrees.

In certain exemplary embodiments the spray well defines a maximum width, wherein the main fuel orifice defines a maximum width, and wherein the maximum width of the spray well is at least about twice as large as the maximum width of the main fuel orifice.

In certain exemplary embodiments the taper extends from the main fuel orifice to the side wall.

In certain exemplary embodiments a bottom edge of the taper extends in a substantially straight direction from the main fuel orifice generally towards the side wall.

In certain exemplary embodiments the side wall of the spray well defines a maximum height, wherein the taper in the bottom wall defines a maximum height, and wherein the maximum height of the taper is at least about five percent of the maximum height of the side wall of the spray well. For example, in certain exemplary embodiments, the maximum height of the taper is at least about ten percent of the maximum height of the side wall of the spray well.

In certain exemplary embodiments the fuel post further defines a top surface, wherein the top surface of the fuel post defines a scarf extending away from the spray well.

In certain exemplary embodiments the fuel post is configured as one of a plurality of fuel posts, wherein each fuel post defines a spray well and a main fuel orifice, the spray well of each fuel post defining a bottom surface, a side wall, and a taper in the bottom surface extending from the main fuel orifice towards the side wall. For example, certain exemplary embodiments each of the plurality of fuel posts further defines a top surface, wherein the top surfaces of each of the plurality of fuel posts each define a scarf extending away from the spray well.

In another exemplary embodiment of the present disclosure, a gas turbine engine is provided. The gas turbine engine includes a compressor section, a turbine section, and a combustion section located downstream of the compressor section and upstream of the turbine section. The combustion section includes a fuel nozzle defining a centerline axis. The fuel nozzle includes an outer body extending generally along the centerline axis and defining an exterior surface, the outer body defining a plurality of openings in the exterior surface. The fuel nozzle also includes a main injection ring disposed at least partially inside the outer body. The main injection ring includes a fuel post extending into or through one of the plurality of openings of the outer body. The fuel post defines a spray well and a main fuel orifice, the spray well defining a bottom surface, a side wall, and a taper in the bottom surface extending from the main fuel orifice towards the side wall.

In certain exemplary embodiments the main fuel orifice defines a centerline, wherein the taper extends at least about twenty degrees about the centerline of the main fuel orifice.

In certain exemplary embodiments the main fuel orifice defines a centerline, wherein the taper extends at least about forty-five degrees about the centerline of the main fuel orifice.

In certain exemplary embodiments the fuel post defines a top surface, wherein the taper defines a projection angle with a reference plane extending parallel to the top surface, and wherein the projection angle is greater than zero degrees and less than about seventy-five degrees.

In certain exemplary embodiments the spray well defines a maximum width, wherein the main fuel orifice defines a maximum width, and wherein the maximum width of the spray well is at least about twice as large as the maximum width of the main fuel orifice.

In certain exemplary embodiments the taper extends from the main fuel orifice to the side wall.

In certain exemplary embodiments a bottom edge of the taper extends in a substantially straight direction from the main fuel orifice generally towards the side wall.

In certain exemplary embodiments the side wall of the spray well defines a maximum height, wherein the taper in the bottom wall defines a maximum height, and wherein the maximum height of the taper is at least about five percent of the maximum height of the side wall of the spray well.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 is a schematic cross-sectional view of an exemplary gas turbine engine according to various embodiments of the present subject matter.

DETAILED DESCRIPTION

Figure 7:
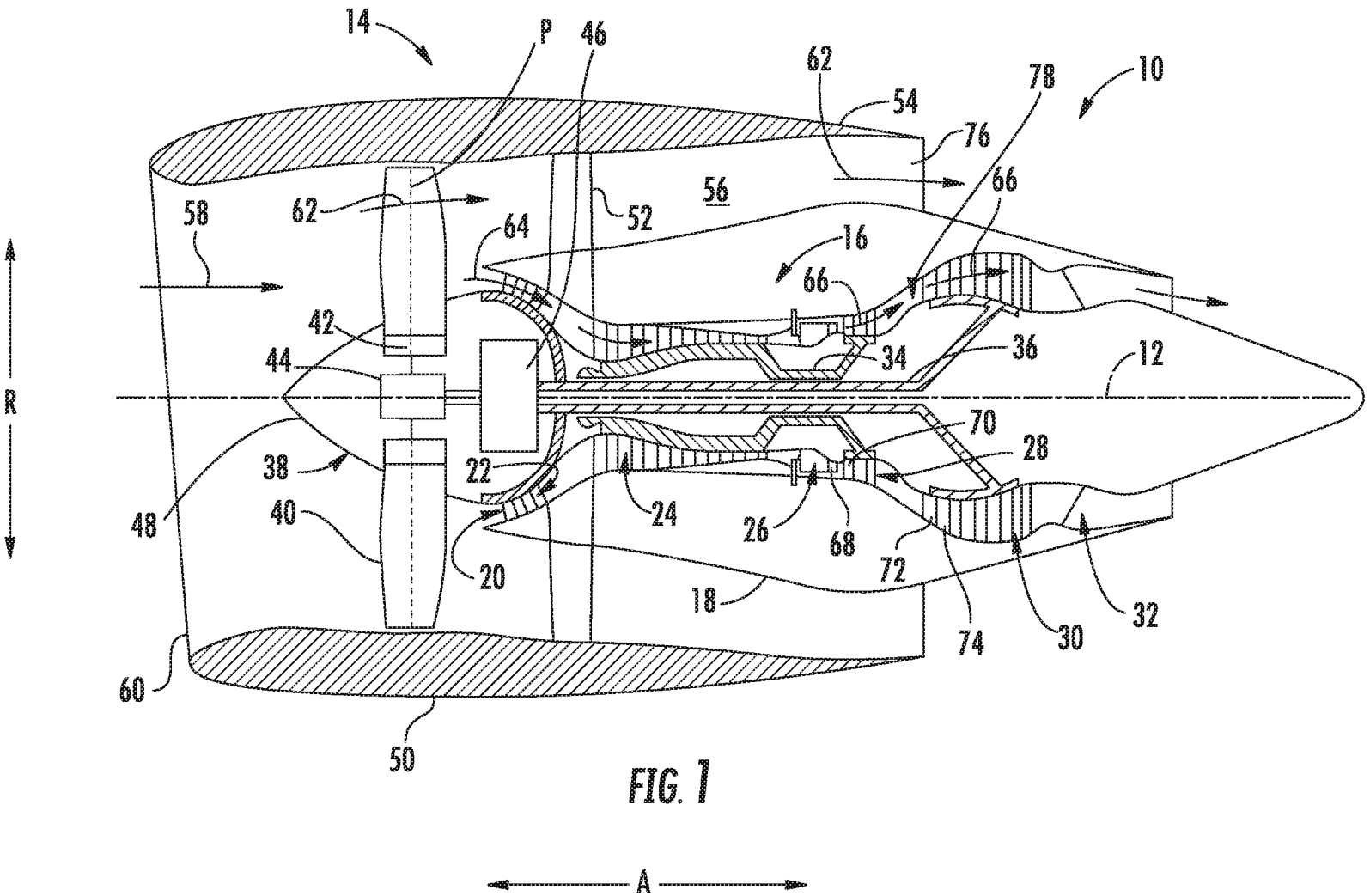
FIG. 7 is a side, cross-sectional view of the exemplary fuel post of FIG. 6.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components.

The terms "forward" and "aft" refer to relative positions within a gas turbine engine, with forward referring to a position closer to an engine inlet and aft referring to a position closer to an engine nozzle or exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems.

Here and throughout the specification and claims, range limitations may be combined and interchanged, such that ranges identified include all the sub-ranges contained therein unless context or language indicates otherwise.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference), a radial direction R, and a circumferential direction (i.e., a direction extending about the axial direction A; not depicted). In general, the turbofan 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22. The compressor section, combustion section 26, turbine section, and jet exhaust nozzle section 32 together define a core air flowpath 37 through the core turbine engine 16.

For the embodiment depicted, the fan section 14 includes a variable pitch fan 38 having a plurality of fan blades 40 coupled to a disk 42 in a spaced apart manner. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, disk 42, and actuation member 44 are together rotatable about the longitudinal axis 12 by LP shaft 36 across a power gear box 46. The power gear box 46 includes a plurality of gears for stepping down the rotational speed of the LP shaft 36 to a more efficient rotational fan speed.

Referring still to the exemplary embodiment of FIG. 1, the disk 42 is covered by rotatable front nacelle 48 aerodynamically contoured to promote an airflow through the plurality of fan blades 40. Additionally, the exemplary fan section 14 includes an annular fan casing or outer nacelle 50 that circumferentially surrounds the fan 38 and/or at least a portion of the core turbine engine 16. It should be appreciated that the nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass airflow passage 56 therebetween.

During operation of the turbofan engine 10, a volume of air 58 enters the turbofan 10 through an associated inlet 60 of the nacelle 50 and/or fan section 14. As the volume of air 58 passes across the fan blades 40, a first portion of the air 58 as indicated by arrows 62 is directed or routed into the bypass airflow passage 56 and a second portion of the air 58 as indicated by arrow 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel provided through one or more fuel nozzles and burned to provide combustion gases 66.

The combustion gases 66 are routed from the combustion section 26, through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core turbine engine 16.

It should be appreciated, however, that the exemplary turbofan engine 10 depicted in FIG. 1 is by way of example only, and that in other exemplary embodiments, the turbofan engine 10 may have any other suitable configuration. Additionally, or alternatively, aspects of the present disclosure may be utilized with any other suitable aeronautical gas turbine engine, such as a turboshaft engine, turboprop engine, turbojet engine, etc. Moreover, aspects of the present disclosure may further be utilized with any other land-based gas turbine engine, such as a power generation gas turbine engine, or any aeroderivative gas turbine engine, such as a nautical gas turbine engine.

Figure 2:
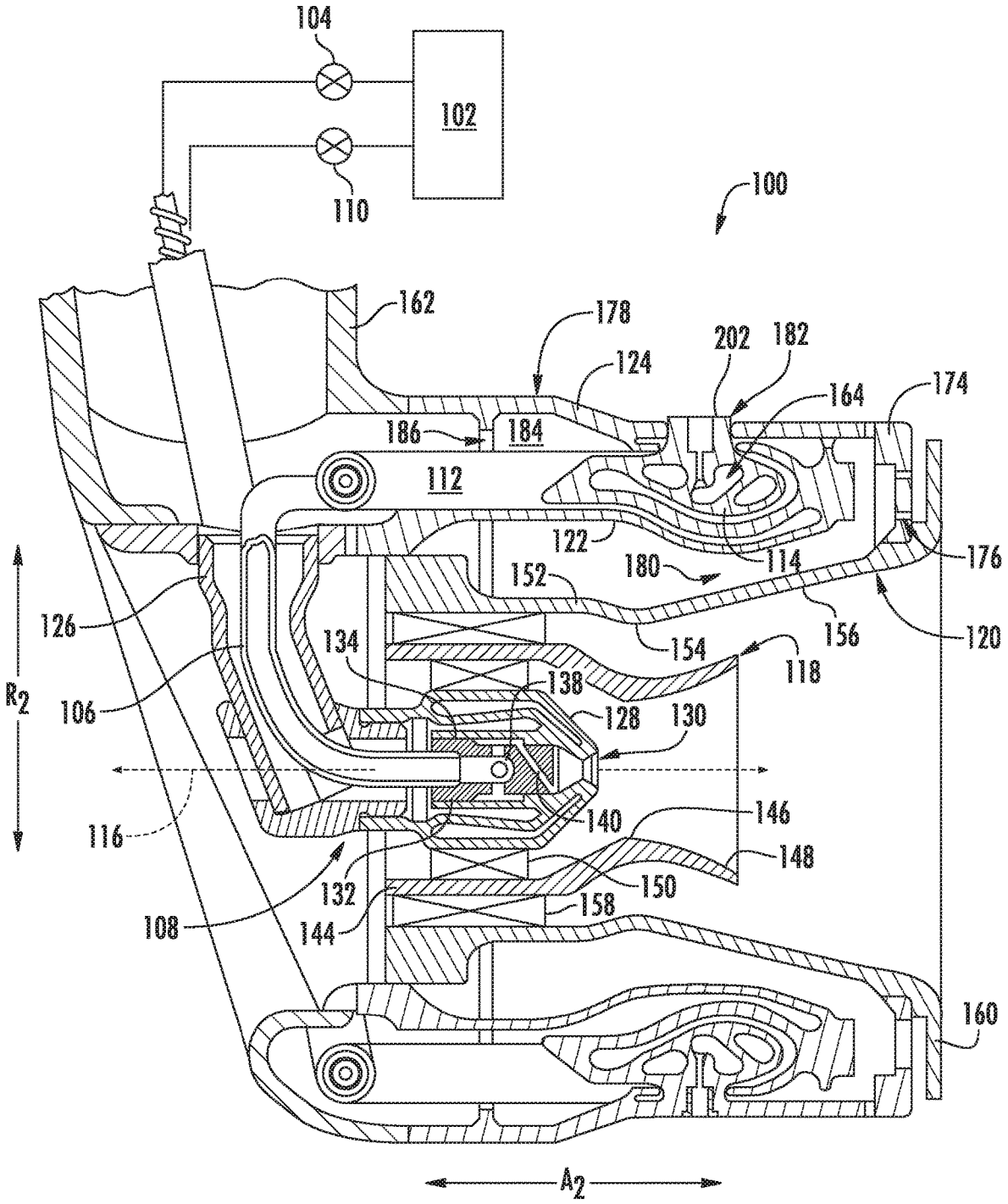
FIG. 2 is a schematic, cross-sectional view of a fuel nozzle in accordance with an exemplary embodiment of the present disclosure.

Referring now to FIG. 2, a side, cross-sectional view is provided of a fuel nozzle 100 in accordance with an exemplary embodiment of the present disclosure. The exemplary fuel nozzle 100 depicted in FIG. 2 may be included within a combustor assembly of the exemplary combustion section 26 described above with reference to FIG. 1. Alternatively, however, the exemplary fuel nozzle 100 of FIG. 2 may instead be included within a combustor assembly of a combustion section 26 of any other suitable gas turbine engine.

The exemplary fuel nozzle 100 of FIG. 2 may be configured to inject liquid hydrocarbon fuel into an airflow stream of the combustor assembly with which it is included. The fuel nozzle 100 is of a "staged" type, meaning it is operable to selectively inject fuel through two or more discrete stages, each stage being defined by individual fuel flowpaths within the fuel nozzle 100. A fuel flowrate may also be variable within each of the stages.

The fuel nozzle 100 is connected to a fuel system 102 operable to supply a flow of liquid fuel at varying flowrates according to operational need. The fuel system 102 supplies fuel to a pilot control valve 104 which is coupled to a pilot fuel conduit 106, which in turn supplies fuel to a pilot 108 of the fuel nozzle 100. The fuel system 102 also supplies fuel to a main valve 110 which is coupled to a main fuel conduit 112, which in turn supplies a main injection ring 114 of the fuel nozzle 100.

The fuel nozzle 100 generally defines an axial direction A2 extending along a centerline axis 116, a radial direction R2, and a circumferential direction C2. The centerline axis 116 of the fuel nozzle 100 may generally be parallel to a longitudinal centerline of a gas turbine engine within which it is installed (see, e.g., longitudinal centerline 12 of turbofan engine 10 of FIG. 1). Starting from the centerline axis 116 and proceeding outwardly along the radial direction R2, the illustrated fuel nozzle 100 includes: the pilot 108, a splitter 118, a venturi 120, an inner body 122, the main injection ring 114, and an outer body 124. Each of these structures will be described in more detail below.

The pilot 108 is disposed at an upstream end of the fuel nozzle 100, aligned with the centerline axis 116 and surrounded by a fairing 126. The illustrated pilot 108 includes a generally cylindrical, axially-elongated, pilot centerbody 128. An upstream end of the pilot centerbody 128 is connected to the fairing 126. The downstream end of the pilot centerbody 128 includes a converging-diverging discharge orifice 130 with a conical exit.

A metering plug 132 is disposed within a central bore 134 of the pilot centerbody 128. The metering plug 132 communicates with the pilot fuel conduit. The metering plug 132 includes transfer holes 136 that flow fuel to a feed annulus 138 defined between the metering plug 132 and the central bore 134, and also includes an array of angled spray holes 140 arranged to receive fuel from the feed annulus 138 and flow it towards the discharge orifice 130 in a swirling pattern, with a tangential velocity component.

The annular splitter 118 surrounds the pilot injector 108. It includes, in axial sequence: a generally cylindrical upstream section 144, a throat 146 of minimum diameter, and a downstream diverging section 148. Additionally, an inner air swirler comprises a radial array of inner swirl vanes 150 which extend between the pilot centerbody 128 and the upstream section 144 of the splitter 118. The inner swirl vanes 150 are shaped and oriented to induce a swirl into air flow passing through the inner air swirler.

The annular venturi 120 surrounds the splitter 118. It includes, in axial sequence: a generally cylindrical upstream section 152, a throat 154 of minimum diameter, and a downstream diverging section 156. A radial array of outer swirl vanes 158, defining an outer air swirler, extends between the splitter 118 and the venturi 120. The outer swirl vanes 158, splitter 118, and inner swirl vanes 150 physically support the pilot 108. The outer swirl vanes 158 are shaped and oriented to induce a swirl into air flow passing through the outer air swirler. The bore of the venturi 120 defines a flowpath for a pilot air flow, generally designated "P", through the fuel nozzle 100. A heat shield 160 in the form of an annular, radially-extending plate may be disposed at an aft end of the diverging section 156. A thermal barrier coating (TBC) (not shown) of a known type may be applied on the surface of the heat shield 160 and/or the diverging section 156.

The inner body 122 may be connected to the fairing 126 and serves as part of a mechanical connection between the main injection ring 114 and stationary mounting structure such as a fuel nozzle stem, a portion of which is shown as item 162.

The main injection ring 114 is for the embodiment depicted annular in form and surrounds the inner body 122. More specifically, the main injection ring 114 extends generally about the centerline axis 116 (i.e., in a circumferential direction C2). It is connected to the inner body 122 and to the outer body 124 by a suspension structure 188 which is described in more detail below with reference to FIG. 3.

Figure 3:
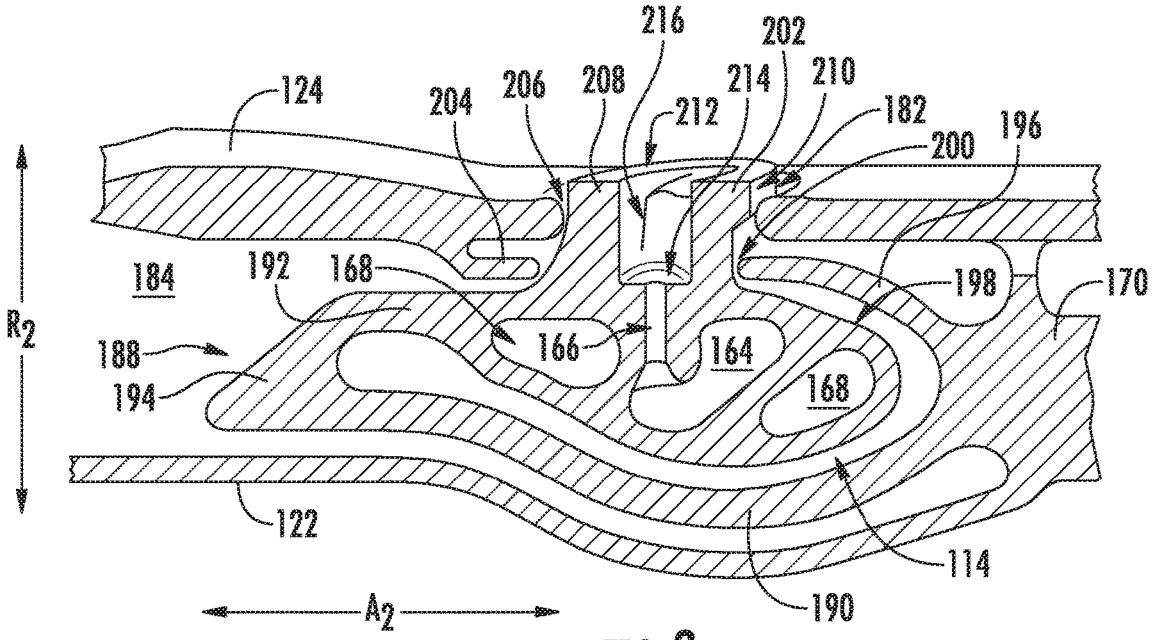
FIG. 3 is a close-up, cross-sectional view of a section of the exemplary fuel nozzle of FIG. 2.

Referring now also to FIG. 3, providing a close-up view of the exemplary main injection ring 114, the main injection ring 114 includes a main fuel gallery 164 (sometimes also referred to as a main fuel tube). The main fuel gallery 164 is coupled to and supplied with fuel by the main fuel conduit 112. A radial array of main fuel orifices 166 formed in the main injection ring 114 communicate with the main fuel gallery 164. During engine operation, fuel is discharged through the main fuel orifices 166. Running through the main injection ring 114 closely adjacent to the main fuel gallery 164 are one or more pilot fuel galleries 168. During engine operation, fuel may constantly circulate through the pilot fuel galleries 168 to cool the main injection ring 114 and prevent coking of the main fuel gallery 164 and the main fuel orifices 166.

The outer body 124 is generally annular in shape for the embodiment depicted and generally defines the outer extent of the fuel nozzle 100. Accordingly, the main injection ring 114 is disposed at least partially inside the outer body 124, or rather is disposed substantially inside the outer body 124, as is the venturi 120 and the pilot 108. In the illustrated example, an aft end of the inner body 122 is connected to the outer body 124 by a radially-extending flange 170. A forward end of the outer body 124 is joined to the stem 162 when assembled (see FIG. 2). An aft end of the outer body 124 may include an annular, radially-extending baffle 174 incorporating cooling holes 176 directed at the heat shield 160. Extending between the forward and aft ends is a generally cylindrical exterior surface 178. In operation, the exterior surface 178 defines an airflow direction in which a mixer airflow, generally designated "M", flows over the exterior surface 178. Accordingly, as will be described in greater detail below, the mixer airflow generally swirls around the exterior surface 178 of the outer body 124 along the mixer airflow direction M.

The exemplary outer body 124 of FIG. 2 additionally defines a secondary flowpath 180, in cooperation with the venturi 120 and the inner body 122. Air passing through this secondary flowpath 180 is discharged through the cooling holes 176.

Moreover, referring still to FIGS. 2 and 3, the outer body 124 additionally defines a plurality of openings 182 in the exterior surface 178 of the outer body 124. Each of the main fuel orifices 166 is aligned with one of the openings 182. Additionally, for the embodiment of FIGS. 2 and 3, the plurality of openings 182 are arranged in an annular array, spaced substantially evenly along the circumferential direction C2 of the fuel nozzle 100. As is described below, fuel posts 202 extend into or through these openings 182.

The outer body 124 and the inner body 122 cooperate to define an annular tertiary space or void 184 protected from the surrounding, external air flow. The main injection ring 114 is contained in this void 184. Within the fuel nozzle 100, a flowpath is provided for the tip air stream to communicate with and supply the void 184 a minimal flow needed to maintain a small pressure margin above the external pressure at locations near the openings 182. In the illustrated example, this flow is provided by a relatively small supply slot 186.

The fuel nozzle 100 and its constituent components may be constructed from one or more metallic alloys. Nonlimiting examples of suitable alloys include nickel and cobalt-based alloys.

All or part of the fuel nozzle 100 or portions thereof may be part of a single unitary, one-piece, or monolithic component, and may be manufactured using a manufacturing process which involves layer-by-layer construction or additive fabrication (as opposed to material removal as with conventional machining processes). Such processes may be referred to as "rapid manufacturing processes" and/or "additive manufacturing processes," with the term "additive manufacturing process" being used herein to refer generally to such processes. Additive manufacturing processes include, but are not limited to: Direct Metal Laser Melting (DMLM), Laser Net Shape Manufacturing (LNSM), electron beam sintering, Selective Laser Sintering (SLS), 3D printing, such as by inkjets and laserjets, Sterolithography (SLA), Electron Beam Melting (EBM), Laser Engineered Net Shaping (LENS), and Direct Metal Deposition (DMD).

The main injection ring 114 is attached to the inner body 122 and to the outer body 124 by a suspension structure 188. The suspension structure 188 includes an annular inner arm 190 extending forward from the flange 170 generally along the axial direction A2. The inner arm 190 passes radially inboard of the main injection ring 114. In section view, the inner arm 190 is curved convex-inward, and is spaced-away from and generally parallels the convex curvature of an inner surface 148 of the main injection ring 114. An annular outer arm 192 extends axially forward from the main injection ring 114. A U-bend 194 interconnects the inner and outer arms 190, 192 at a location forward of the main injection ring 114 along the axial direction A2. A baffle 196 extends forward from the flange 170 also generally along the axial direction A2. The baffle 196 passes radially outboard of the main injection ring 114, between the main injection ring 114 and the outer body 124. In section view the baffle 196 is curved convex-outward, and is spaced-away from and generally parallels the convex curvature of an outer surface 198 of the main injection ring 114. The baffle 196 includes an opening 200 through which a fuel post 202 (described in greater detail below) passes, and a forward end 204 of the baffle is connected to the outer body 124 forward of the opening 200. Notably, for the embodiment depicted, the fuel post 202 at least partially defines the main fuel orifice 166.

The suspension structure 188 is effective to substantially rigidly locate the position of the main injection ring 114 in axial and circumferential directions A2, C2 while permitting controlled deflection in a radial direction R2. This is accomplished by the size, shape, and orientation of the elements of the suspension structure 188. In particular, the inner and outer arms 190, 192 and the U-bend 194 are configured to act as a spring element in the radial direction R2. In effect, the main injection ring 114 substantially has one degree of freedom of movement ("1-DOF").

It should be appreciated, however, that the fuel nozzle 100 described above is by way of example only, and that in other exemplary embodiments the fuel nozzle 100 may have any other suitable configuration, and may be formed in any other suitable manner. For example, in other exemplary embodiments the main injection ring 114 may instead be mounted to the outer body 124 in any other suitable manner.

Referring still to FIGS. 2 and 3, the main injection ring 114, main fuel orifices 166, and openings 182 may be configured to provide a controlled secondary purge air path and an air assist at the main fuel orifices 166 through perimeter gaps 206 defined around the fuel posts 202. The openings 182 are oriented in a radial direction R2 relative to the centerline axis 116, and each fuel post 202 is aligned with one of the openings 182 and is positioned to define the perimeter gap 206 in cooperation with the associated opening 182. These small controlled gaps 206 around the fuel posts 202 permit minimal purge air to flow through to protect internal tip space or void 96 from fuel ingress.

During engine operation, the outer body 124 is exposed to a flow of high-temperature air and therefore experiences relatively significant thermal expansion and contraction, while the main injection ring 114 is constantly cooled by a flow of liquid fuel and remains relative stable. The effect of the suspension structure 188 is to permit thermal growth of the outer body 124 relative to the main injection ring 114 and centerline axis 116 while maintaining a size of perimeter gaps 206 described above, thereby maintaining the effectiveness of the purge flow.

Additionally, as briefly mentioned above, the main injection ring 114 includes a plurality of raised fuel posts 202 extending outwardly along the radial direction R2 from the main fuel gallery 164 of the main injection ring 114 into or through the plurality of openings 182 of the outer body 124. The fuel posts 202 include a perimeter wall 208 defining a lateral surface 210. Additionally, the fuel posts 202 define a distal, top surface 212, a radially-facing floor 214 recessed from the top surface 212, and a spray well 216 therebetween. The spray well 216 is fluidly connected with a respective main fuel orifice 166 to receive a flow of fuel therefrom. Additionally, as is indicated the main fuel gallery 164 extends generally about the centerline axis 116 (e.g., in a circumferential direction C2) fluidly connecting the array of fuel posts 202, or more particularly, fluidly connecting with each of the main fuel orifices 166 and the spray wells 216 of the respective fuel posts 202. Accordingly, it will be appreciated that each of the main fuel orifices 166 extends through the floor 214 of the respective fuel post 202 to fluidly connect with the spray well 216 of the respective fuel post 202 to the respective main fuel orifice 166.

Figure 4:
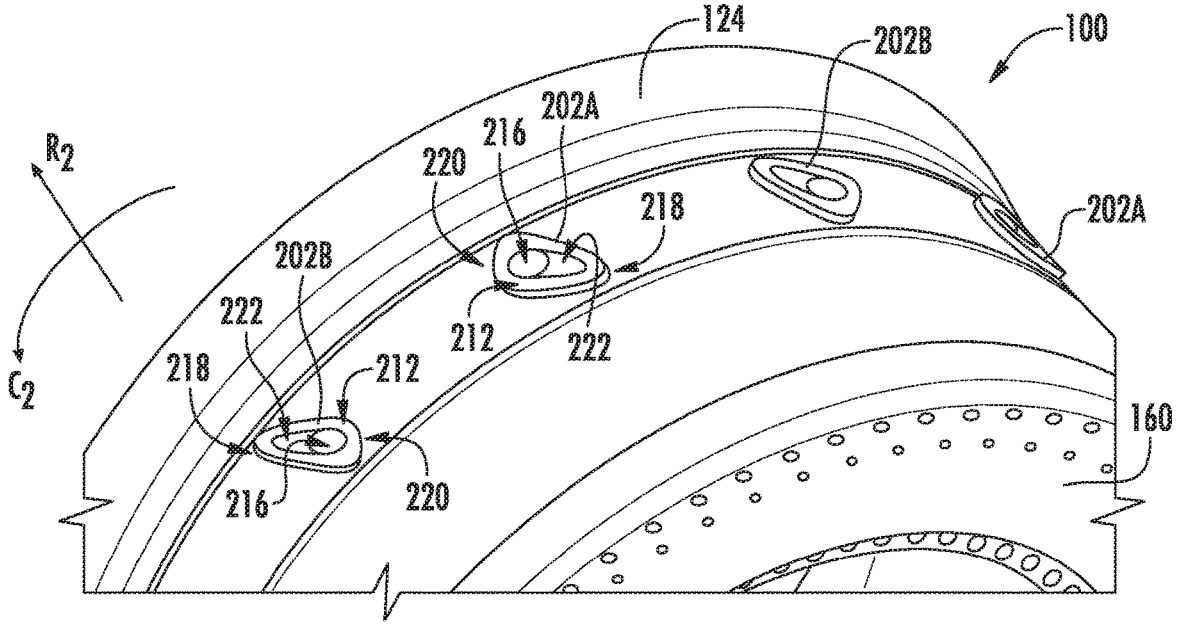
FIG. 4 is a perspective view of a section of the exemplary fuel nozzle of FIG. 2.
Figure 5:
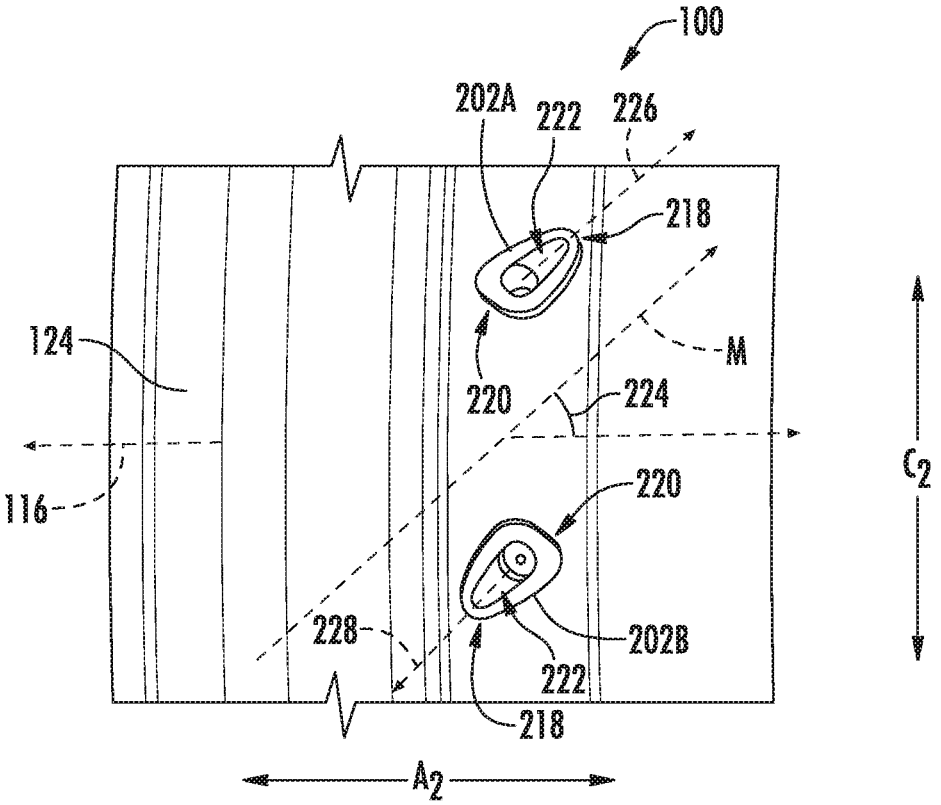
FIG. 5 is a plan view of a section of the exemplary fuel nozzle of FIG. 2.

Referring now to FIGS. 4 and 5, additional views of a portion of the exemplary fuel nozzle 100 of FIGS. 2 and 3 are provided. FIG. 4 provides a perspective view of the exemplary fuel nozzle 100, and FIG. 5 provides a top, plan view of a portion of the exemplary fuel nozzle 100.

As is depicted, the openings 182 define a shape substantially similar to a shape of the top surface 212 of the respective fuel post 202. Additionally, for the embodiment depicted, the top surfaces 212 of the plurality of fuel posts 202 each generally define at least one of a teardrop shape, an ovular shape, a circular shape, or an elliptical shape. More specifically, in the example illustrated the top surfaces 212 of the plurality of fuel posts 202 are each "teardrop-shaped," having two convex-curved ends, with one end having a greater width than the other end (e.g., a greater maximum radius of curvature). Accordingly, the top surface 212 of each of the fuel posts 202 includes a narrow end 218 (i.e., the end with the lesser width) and a wide end 220 (i.e., the end with the greater width).

The elongated shape of the fuel posts 202 provides surface area so that the top end 212 of one or more of the fuel posts 202 can be configured to incorporate a ramp-shaped "scarf" 222. The scarfs 222 can be arranged to generate local static pressure differences between other main fuel orifices 166 (e.g., adjacent main fuel orifices 166). These local static pressure differences between main fuel orifices 166 may be used to purge stagnant main fuel from the main injection ring 114 during periods of pilot-only operation as to avoid main circuit coking.

The orientation of the scarf 222 determines the static air pressure present at the associated main fuel orifice 166 during engine operation. The mixer air flowing in the airflow direction M defined by the outer body 124 exhibits "swirl," that is, its velocity has both axial and circumferential components relative to the centerline axis 116. More specifically, for the exemplary embodiment depicted, the airflow direction M defines an angle 224 with the centerline axis 116 greater than zero degrees and less than about seventy-five degrees. More specifically, for the exemplary embodiment depicted, the angle 224 between the airflow direction M and the centerline axis 116 is between about fifteen degrees and about sixty degrees, such as between about thirty degrees and about forty-five degrees. Notably, however, in other exemplary embodiments, the mixer air may flow/swirl in the other direction, such that the angle 224 defined between the airflow direction M and the centerline axis 116 is the reverse of the angles defined above (i.e., the negative of). Alternatively, in still other embodiments, the mixer air may define an angle 224 with the centerline axis 116 substantially equal to zero, such that the mixer air flows generally along the centerline axis 116.

To achieve the purge function mentioned above, the spray wells 216 may be arranged such that different ones of the main fuel orifices 166 are exposed to different static pressures during engine operation. For example, the exemplary fuel nozzle 100 depicted, and more specifically, the exemplary main injection ring 114 depicted includes an LP fuel post 202A, as well as an HP fuel post 202B. The LP fuel post 202A is generally configured to generate a "low static pressure" (i.e., a reduced static pressure relative to a prevailing static pressure in the mixer airflow) and the HP fuel post 202B is generally configured to generate a "high static pressure" (i.e., an increased static pressure relative to a prevailing static pressure in the mixer airflow). Each of the LP fuel post 202A and the HP fuel post 202B defines a spray well 216, a top surface 212, and a scarf 222. The scarf 222 of the LP fuel post 202A extends in the top surface 212 from the spray well 216 in a first direction 226 relative to the centerline axis 116. By contrast, the scarf 222 of the HP fuel post 202B extends in the top surface 212 from the spray well 216 in a second direction 228 relative to the centerline axis 116. The second direction 228 is at least about ninety degrees different than the first direction 226, and the first direction 226 is substantially aligned with the airflow direction M defined by the outer body 124. More specifically, for the embodiment depicted, the second direction 228 is about one hundred eighty degrees different than the first direction 226, such that the scarf 222 of the HP fuel post 202B extends upstream with respect to the airflow direction M.

Accordingly, the scarf 222 of the LP fuel post 202A may generally be referred to as a "downstream" scarf, while the scarf 222 of the HP fuel post 202B may generally be referred to as an "upstream" scarf. Additionally, as discussed, the top surfaces 212 of the LP and HP fuel posts 202A, 202B each generally define a teardrop shape including a narrow end 218 and a wide end 220. For the top surface 212 of the HP fuel post 202B, the narrow end 218 is positioned forward of the wide end 220 along the second direction 228 (i.e., upstream relative to the airflow direction M), and similarly, for the LP fuel post 202A, the narrow end 218 is positioned forward of the wide end 220 along the first direction 226 (i.e., downstream relative to the airflow direction M). Notably, however, in other exemplary embodiments, the scarf 202 may have any other suitable shape, and/or the HP fuel post 202B may be oriented in any other suitable manner.

For the embodiment depicted, the LP fuel post 202A is arranged sequentially with the HP fuel post 202B. More particularly, for the exemplary fuel nozzle 100 depicted, the array of fuel posts 202 further includes a plurality of LP fuel posts 202A and a plurality of HP fuel post 202B. Each of the plurality of LP fuel posts 202A are, for the embodiment depicted, configured in substantially the same manner as one another, and further, each of the plurality of HP fuel posts 202B are also configured in substantially the same manner as one another. Referring particularly to the embodiment of FIG. 4, the plurality of LP fuel posts 202A are arranged with the plurality of HP fuel posts 202B in a sequential and alternating manner (i.e., arranged in the following pattern: LP fuel post 202A, HP fuel post 202B, LP fuel post 202A, HP fuel post 202B, etc.)

It should be appreciated, however, that in other exemplary embodiments, the plurality of LP fuel posts 202A and HP fuel posts 202B may instead be arranged in any other suitable manner. For example, in other exemplary embodiments, the plurality of LP fuel posts 202A may be grouped together and the plurality of HP fuel posts 202B may also be grouped together.

Figure 6:
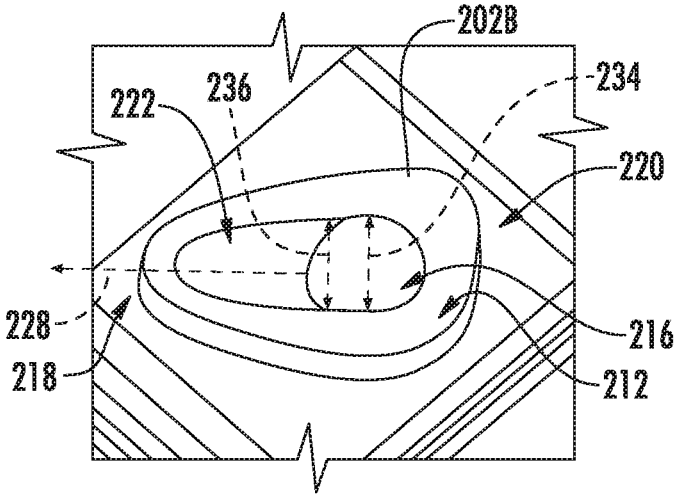
FIG. 6 is a perspective view of a fuel post of a fuel nozzle in accordance with an exemplary embodiment of the present disclosure.
Figure 7:
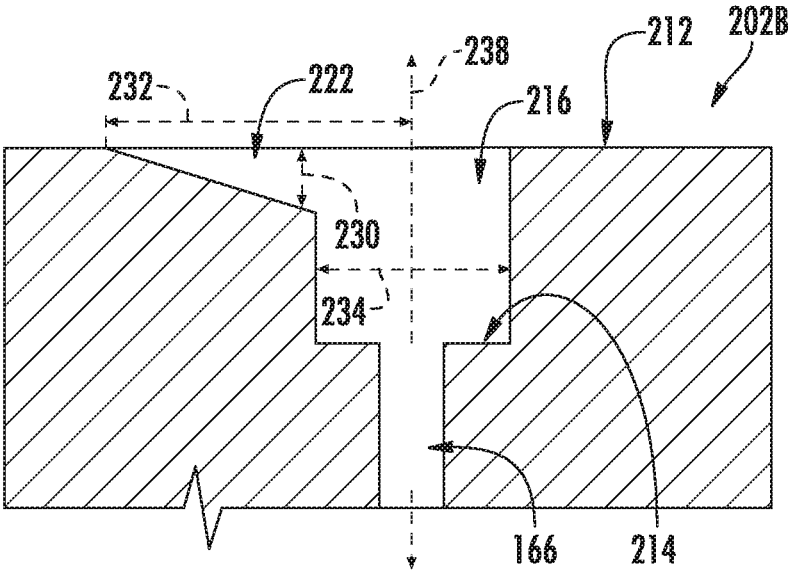

Referring now to FIGS. 6 and 7, a fuel post 202 including a scarf 222 in accordance with an exemplary embodiment of the present disclosure is provided. The exemplary fuel post 202 and scarf 222 of FIGS. 6 and 7 is described as an HP fuel post 202B and scarf 222 (it being appreciated, however, that in other embodiments the fuel post 202 and scarf 222 depicted may instead be an LP fuel post 202A and scarf 222).

As is depicted, the scarf 222 generally defines a height 230 and a length 232. The scarf 222 defines a maximum height 230 at the spray well 216. The length 232 of the scarf 222 extends in a direction parallel to the second direction 228, extending gradually (with, for the embodiment depicted, a constant slope) to a minimum height 230 at a distal end of zero (i.e., flush with the top surface 212). Additionally, the exemplary spray well 216 defines a maximum width 234 and the scarf 222 similarly defines maximum width 236 (e.g., in a plane parallel to the top surface 212). For the embodiment depicted, the maximum width 236 of the scarf 222 is substantially equal to the maximum width 234 of the exemplary spray well 216.

Referring particularly to FIG. 7, the length 232 of the scarf 222 refers to a total length 232 of the scarf 222 beginning at a centerline 238 of the spray well 216 and ending where the scarf 222 becomes flush with the top surface 212. Additionally, the height 230 of the scarf 222 refers to a maximum height 230 of the scarf 222. For the embodiment depicted, the length 232 may generally be greater than about forty thousandths of an inch ("mils") and less than about three hundred mils. For example, in certain exemplary embodiments, the length 232 may generally be greater than about fifty mils and less than about two hundred and fifty mils, such as greater than about seventy-five mils and less than about two hundred mils. Additionally, the height 230 of the scarf 222 may generally be greater than about five mils and less than about fifty mils. For example, in certain exemplary embodiments, the height 230 of the scarf 222 may generally be greater than about ten mils and less than about forty mils, such as greater than about fifteen mils and less than about thirty mils.

As stated, for the embodiment depicted, the fuel post 202 is configured as an HP fuel post 202B, such that the scarf 222 is configured as an upstream scarf 222. Accordingly, in at least certain exemplary embodiments, the scarf 222 may define a length 232 to height 230 ratio between about one and a half (1.5) and about five, such as between about two and about four. However, in other exemplary embodiments, the fuel post 202 depicted may instead be configured as an LP fuel post 202A, such that the scarf 222 is configured as a downstream scarf 222. With such an exemplary embodiment, the scarf 222 may define a length 232 to height 230 ratio between about four and about nine, such as between about five and about eight. Accordingly, for certain exemplary fuel nozzles 100 the upstream scarf 222 may define a length 232 to height 230 ratio that is less than a length 232 to height 230 ratio of the downstream scarf 222 (such as at least about twenty percent less, such as at least about thirty percent less, such as at least about forty percent less, such as at least about fifty percent less).

Notably, in other exemplary embodiments, one or more of the LP fuel posts 202A and/or HP fuel posts 202B may define any other suitable scarf 222 in the respective top surfaces 212. For example, in other exemplary embodiments, LP fuel posts 202A and/or HP fuel posts 202B may be oriented such that the scarf 222 extends from the spray well 216 towards the wide end 220 of the respective fuel post. With such an exemplary embodiment, the scarf may be configured as a channel extending with, e.g., a substantially constant depth along a length 232 thereof through an outer edge of the top surface 212 of the fuel post 202.

As will be appreciated, inclusion of a fuel nozzle including a main injection ring having one or more fuel posts extending into or through respective openings in an outer body of the fuel nozzle with upstream scarfs, in combination with one or more fuel posts extending into or through respective openings in the outer body of the fuel nozzle with downstream scarfs, may provide for a greater pressure differential to provide the desired fuel purging. Such a configuration may therefore result in less fuel coking, and therefore may increase a useful life of the fuel nozzle.

It should be appreciated, however, that in other embodiments, the fuel nozzle 100 may have any other suitable configuration. For example, referring now to FIG. 8, a side, cross-sectional view is provided of a fuel post 202 of a fuel nozzle 100 in accordance with another exemplary embodiment of the present disclosure. The exemplary fuel post 202 and fuel nozzle 100 depicted in FIG. 8 may be configured in substantially the same manner as one or more of the exemplary fuel posts 202 and fuel nozzles 100 described above with reference to FIG. 2 through 7. For example, in certain exemplary embodiments, the fuel post 202 may be an LP fuel post 202A or an HP fuel post 202B.

Figure 8:
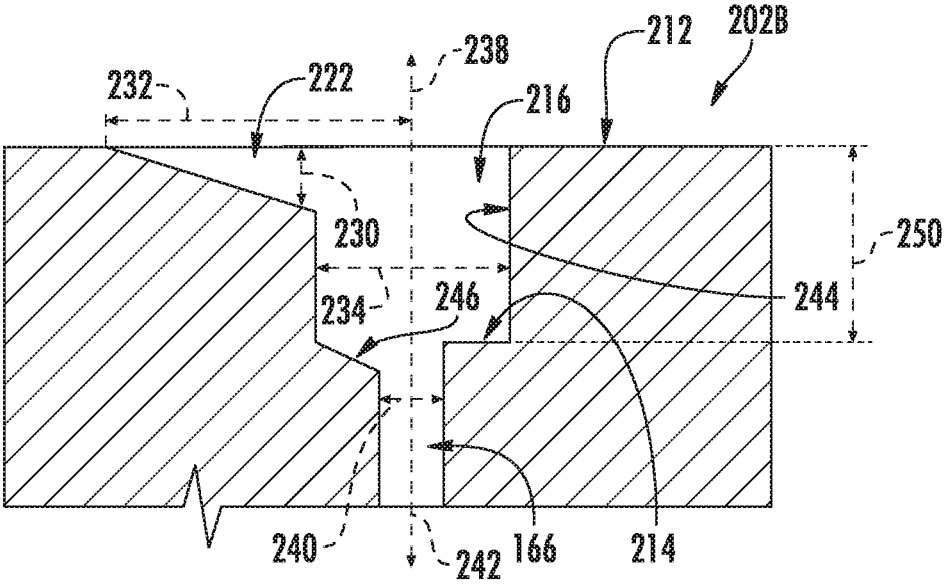
FIG. 8 is a side, cross-sectional view of a fuel post of a fuel nozzle in accordance with another exemplary embodiment of the present disclosure.

More specifically, the exemplary fuel post 202 of FIG. 8 generally defines a top surface 212, a spray well 216, and a main fuel orifice 166. Additionally, for the embodiment depicted the fuel post 202 includes a scarf 222 defined in the top surface 212 of the fuel post 202, extending from the spray well 216. The scarf 222 is configured in substantially the same manner as the exemplary scarf 222 described above with reference to FIGS. 6 and 7. However, in other exemplary embodiments, the scarf 222 may have any other suitable configurations, or alternatively the fuel post 202 may not include a scarf altogether. For example, in other exemplary embodiments, the top surface 212 may be substantially completely flat and continuous, with the exception only of the spray well 216.

Referring still to FIG. 8, the spray well 216 defines a maximum width 234 and the main fuel orifice 166 also defines a maximum width 240. The maximum width 234 of the spray well 216 is defined in a direction perpendicular to a centerline 238 of the spray well 216, and similarly, the maximum width 240 of the main fuel orifice 166 is defined in a direction perpendicular to a centerline 242 of the main fuel orifice 166. Notably, for the embodiment depicted the centerline 242 of the main fuel orifice 166 is aligned with the centerline 238 of the spray well 216. Additionally, for the embodiment depicted the maximum width 234 of the spray well 216 is at least about twice as large as the maximum width 240 of the main fuel orifice 166, such as at least about three times as large, and up to about ten times as large as the maximum width 240 of the main fuel orifice 166.

Moreover, the spray well 216 generally includes one or more side walls 244 and a bottom wall 214. In contrast to the previously discussed fuel posts 202, for the embodiment of FIG. 8, the spray well 216 of the fuel post 202 additionally defines a taper 246 in the bottom wall 214 extending from the main fuel orifice 166 towards the side wall 244 of the spray well 216. As will be discussed in greater detail below, such may reduce an overall surface tension of fuel in the spray well 216, such that less pressure is required to force the fuel back through the main fuel orifice 166 during purging operations of the fuel nozzle 100.

Figure 9:
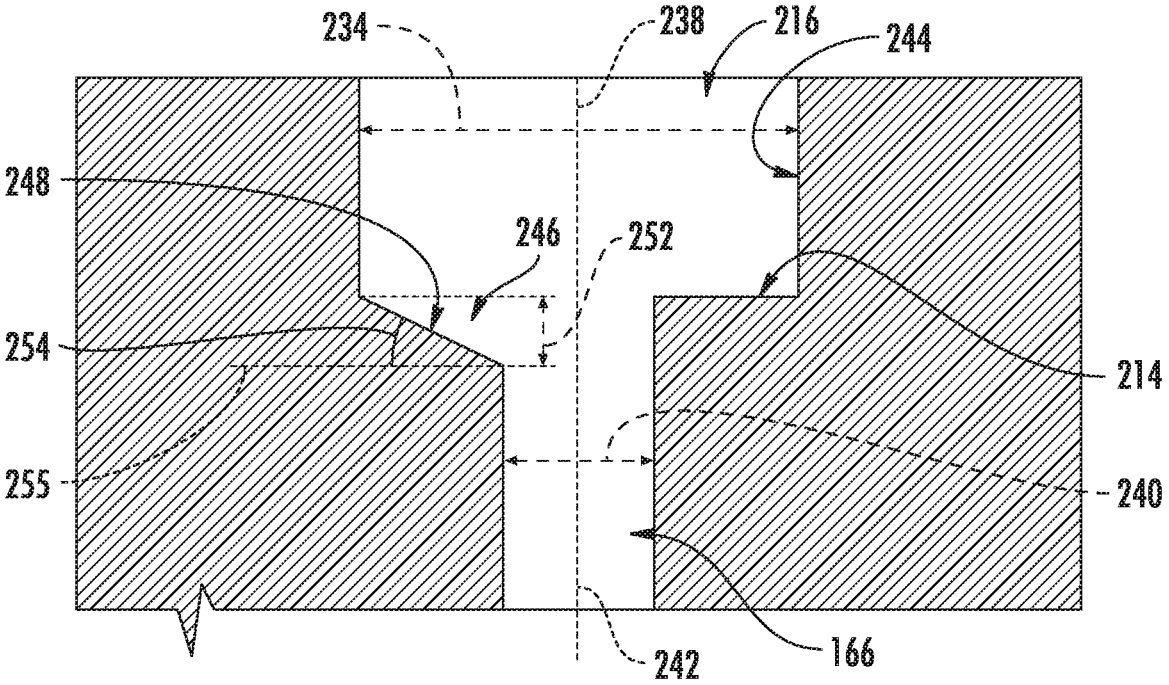
FIG. 9 is a close-up, side, cross-sectional view of the exemplary fuel post of FIG. 8.

Referring now also to FIG. 9, a close-up view is provided of the exemplary fuel post 202 of FIG. 8, depicting the taper 246 defined in the bottom wall 214 of the spray well 216 in greater detail. As is depicted, for the embodiment of FIG. 9 the taper 246 extends in a substantially straight direction from the main fuel orifice 166 generally towards a side wall 244 of the spray well 216. More specifically, a bottom edge 248 of the taper 246 defines a substantially straight line extending from the main fuel orifice 166 generally towards the side wall 244 of the spray well 216. Moreover, for the embodiment depicted the taper 246 extends from the main fuel orifice 166 all the way to the side wall 244. Notably, however, in other exemplary embodiments, the taper 246 may extend between about 40% and 100% of the way to the side wall 244 (measured as a percent of a radius of the spray well 216, or one half of the width 234 of the spray well 216), such as between about 50% and 100%, such as between about 60% and 100%, such as between about 80% and 100%.

Furthermore, for the embodiment depicted, the side wall 244 of the spray well 216 defines a maximum height 250 in a direction parallel to the centerline 238 of the spray well 216 (see FIG. 8). Further, the taper 246 in the bottom wall 214 of the spray well 216 also defines a maximum height 252 in a direction parallel to the centerline 238 of the spray well 216. For the embodiment depicted, the maximum height 252 of the taper 246 is at least about 5% of the maximum height 250 of the side wall 244 of the spray well 216. For example, in certain embodiments, the maximum height 252 of the taper 246 may be at least about 10% of the maximum height 250 of the side wall 244 of the spray well 216, and up to about 100% of the maximum height 250 of the side wall 244 of the spray well 216.

Referring still to FIG. 9, will be appreciated that the taper 246 further defines a projection angle 254. More particularly, the fuel post 202 defines a reference plane 255 extending parallel to the top surface 212 of the fuel post 202, and the taper 246 defines a projection angle 254 with the reference plane 255 (i.e., the angle between the bottom edge 248 of the taper 246 and the reference plane 255). For example, the projection angle 254 is, for the embodiment depicted, greater than 0° and less than about 75°. However, in other embodiments, the projection angle 254 may be any other suitable angle. For example, in other exemplary embodiments, the projection angle 254 may be between about 20° and about 60°.

Referring now to FIGS. 10 through 13, top views are provided of additional exemplary embodiments of fuel posts 202 in accordance with aspects of the present disclosure. More particularly, the views provided in FIGS. 10 through 13 are of a bottom wall 214 of a spray well 216 of the fuel post 202, along the centerline 238 of the spray well 216 of the fuel post 202.

Figure 10:
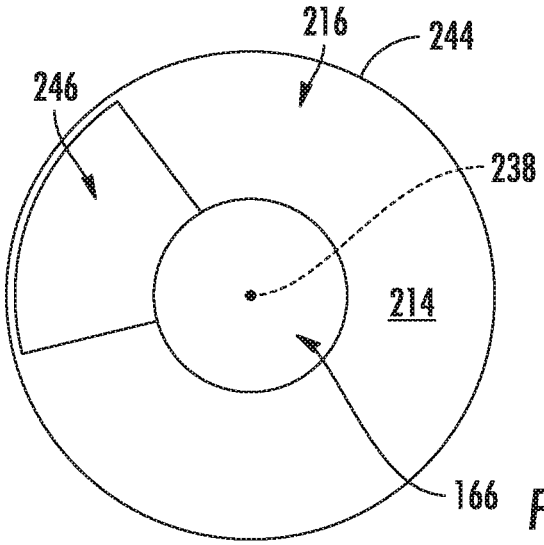
FIG. 10 is a top view of a spray well of a fuel post in accordance with an exemplary embodiment of the present disclosure.
Figure 11:
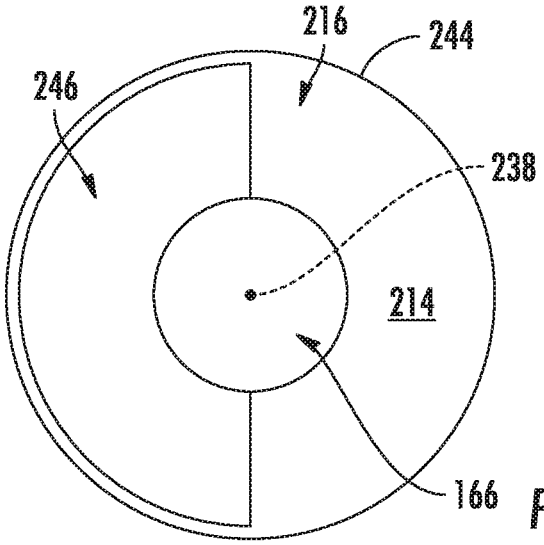
FIG. 11 is a top view of a spray well of a fuel post in accordance with another exemplary embodiment of the present disclosure.
Figure 12:
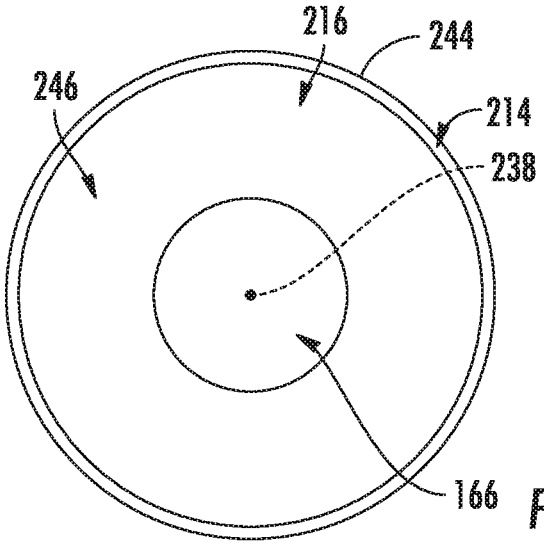
FIG. 12 is a top view of a spray well of a fuel post in accordance with yet another exemplary embodiment of the present disclosure.

As is depicted, each of the embodiments of FIGS. 10 through 13 include a taper 246 extending from a main fuel orifice 166 towards the side wall 244. Referring particularly to FIGS. 10 through 12, the taper 246 extends about the centerline 242 of the main fuel orifice 166 and about the centerline 238 of the spray well 216. As is depicted, the taper 246 may extend about the centerline 238 of the spray well 216 greater than 0° and up to 360°. For example, in certain exemplary embodiments, the taper 246 may extend about the centerline 238 of the spray well 216 at least about 20° (see, e.g., the embodiment of FIG. 10), such as at least about 45°, such as at least about 180° (see, e.g., the embodiment of FIG. 11), such as up to 360° (see, e.g., the embodiment of FIG. 12).

Figure 13:
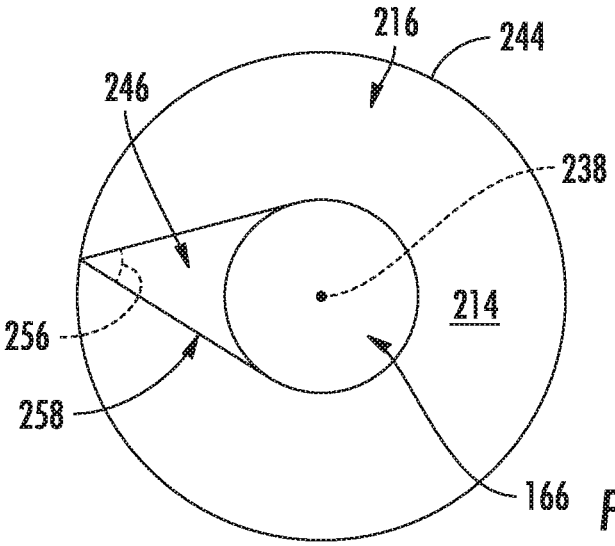
FIG. 13 is a top view of a spray well of a fuel post in accordance with still another exemplary embodiment of the present disclosure.

Notably, however, referring particularly to FIG. 13, in other exemplary embodiments, the taper 246 may instead have any other suitable shape, such as a shape that converges as it extends away from the main fuel orifice 166. For example, for the embodiment depicted in FIG. 13, the taper 246 defines a convergence angle 256. More specifically, side edges 258 of the taper 246 (i.e., the intersections between the taper 246 and the bottom wall 214) define the convergence angle 256. For the embodiment depicted, the convergence angle 256 is between about 0° and about 45°. However, in other embodiments, any other suitable convergence angle 256 may be provided.

Inclusion of a taper in a bottom wall of a spray well of a fuel post in a fuel nozzle may allow for better purging of fuel in the fuel nozzle during purging operations. More specifically, inclusion of the taper may reduce an overall surface tension of fuel in the spray well, such that less pressure is required to force the fuel back through the main fuel orifice during purging operations of the fuel nozzle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel nozzle for a gas turbine engine, the fuel nozzle defining a centerline axis and comprising:

an outer body extending generally along the centerline axis and defining an exterior surface, the outer body defining a plurality of openings in the exterior surface; and a main injection ring disposed at least partially inside the outer body, the main injection ring including a fuel post extending into or through one of the plurality of openings of the outer body, the fuel post defining a spray well and a main fuel orifice, the spray well defining a bottom surface, a side wall, and a taper in the bottom surface extending from the main fuel orifice towards the side wall, wherein fuel post defines a top surface at an exit, wherein the spray well is positioned between the main fuel orifice and the top surface, and wherein the side wall of the spray well extends to the top surface, and wherein the top surface of the fuel post defines a scarf extending away from the spray well.

2. The fuel nozzle of claim 1, wherein the main fuel orifice defines a centerline, and wherein the taper extends at least about twenty degrees about the centerline of the main fuel orifice.

3. The fuel nozzle of claim 1, wherein the main fuel orifice defines a centerline, and wherein the taper extends at least about forty-five degrees about the centerline of the main fuel orifice.

4. The fuel nozzle of claim 1, wherein the taper defines a projection angle with a reference plane extending parallel to the top surface, and wherein the projection angle is greater than zero degrees and less than about seventy-five degrees.

5. The fuel nozzle of claim 1, wherein the spray well defines a maximum width, wherein the main fuel orifice defines a maximum width, and wherein the maximum width of the spray well is at least about twice as large as the maximum width of the main fuel orifice.

6. The fuel nozzle of claim 1, wherein the taper extends from the main fuel orifice to the side wall.

7. The fuel nozzle of claim 1, wherein a bottom edge of the taper extends in a substantially straight direction from the main fuel orifice generally towards the side wall.

8. The fuel nozzle of claim 1, wherein the side wall of the spray well defines a maximum height, wherein the taper in the bottom surface defines a maximum height, and wherein the maximum height of the taper is at least about five percent of the maximum height of the side wall of the spray well.

9. The fuel nozzle of claim 8, wherein the maximum height of the taper is at least about ten percent of the maximum height of the side wall of the spray well.

10. The fuel nozzle of claim 1, wherein the fuel post is configured as one of a plurality of fuel posts, wherein each of the fuel post defines a spray well and a main fuel orifice, the spray well of each of the fuel post defining a bottom surface, a side wall, and a taper in the bottom surface extending from the main fuel orifice towards the side wall.

11. The fuel nozzle of claim 10, wherein each of the plurality of fuel posts further defines a top surface, wherein the top surfaces of each of the plurality of fuel posts each define a scarf extending away from the spray well.

12. The fuel nozzle of claim 1, wherein the fuel post extends through one of the plurality of openings of the outer body.

13. A gas turbine engine comprising:

a compressor section;

a turbine section; and a combustion section located downstream of the compressor section and upstream of the turbine section, the combustion section comprising a fuel nozzle defining a centerline axis and comprising:

an outer body extending generally along the centerline axis and defining an exterior surface, the outer body defining a plurality of openings in the exterior surface; and a main injection ring disposed at least partially inside the outer body, the main injection ring including a fuel post extending into or through one of the plurality of openings of the outer body, the fuel post defining a spray well and a main fuel orifice, the spray well defining a bottom surface, a side wall, and a taper in the bottom surface extending from the main fuel orifice towards the side wall, wherein fuel post defines a top surface at an exit, wherein the spray well is positioned between the main fuel orifice and the top surface, and wherein the side wall of the spray well extends to the top surface, and wherein the top surface of the fuel post defines a scarf extending away from the spray well.

14. The gas turbine engine of claim 13, wherein the main fuel orifice defines a centerline, and wherein the taper extends at least about twenty degrees about the centerline of the main fuel orifice.

15. The gas turbine engine of claim 13, wherein the main fuel orifice defines a centerline, and wherein the taper extends at least about forty-five degrees about the centerline of the main fuel orifice.

16. The gas turbine engine of claim 13, wherein the taper defines a projection angle with a reference plane extending parallel to the top surface, and wherein the projection angle is greater than zero degrees and less than about seventy-five degrees.

17. The gas turbine engine of claim 13, wherein the spray well defines a maximum width, wherein the main fuel orifice defines a maximum width, and wherein the maximum width of the spray well is at least about twice as large as the maximum width of the main fuel orifice.

* * * * *